US005123314A

United States Patent [19]

Wittmann

[11] Patent Number: 5,123,314

[45] Date of Patent: Jun. 23, 1992

[54] ENGINE ROTATE TOOL

[76] Inventor: Raymond H. Wittmann, 1587 N. Thompson Ave., Bay Shore, N.Y. 11706

[21] Appl. No.: 722,020

[22] Filed: Jun. 27, 1991

[51] Int. Cl.[5] ..... B25B 9/00

[52] U.S. Cl. ..... 81/484; 81/488

[58] Field of Search ..... 81/484, 488; 29/278, 29/280

[56] References Cited

U.S. PATENT DOCUMENTS 4,794,683 1/1989 Pocheco ..... 81/488

*Primary Examiner*—Roscoe V. Parker

*Attorney, Agent, or Firm*—Galgano & Belkin

[57] ABSTRACT

A tool for manually rotating the crankshaft of a racing engine. The tool consists of a plate mounted on the torsion damper covering the end of the crankshaft and having a hex head on the outside for engagement with a long handled wrench to provide the leverage to rotate the crankshaft.

1 Claim, 2 Drawing Sheets

ENGINE ROTATE TOOL

BACKGROUND OF THE INVENTION

The present invention relates to a tool and more particularly to a tool for rotating the crankshaft of an internal combustion engine manually.

When the valves of an internal combustion engine are adjusted it is necessary to rotate the crankshaft to make these adjustments at specific points in the engine cycle, and the crankshaft is usually rotated by hand. Typically, this is accomplished by turning the vibration damper which is similar to a small flywheel and is usually mounted on the end of the crankshaft opposite the side of the main flywheel to minimize vibrations due to torsional resonances in the crankshaft which could cause bearing damage. In small engines such as those used in the average personal automobile this poses no great difficulty.

However, in the massive engines employed in racing and drag vehicles, this is a virtually impossible task, even when the spark plugs are removed to relieve the compression, requiring the mechanic to remove the crankshaft bolts to gain access to the crankshaft directly for making these adjustments.

SUMMARY OF THE PRESENT INVENTION

In this invention, the problems involved in the manual rotation of the crankshaft in certain internal combustion engines are largely overcome in a unique way of manually rotating the crankshaft.

In accordance with a preferred embodiment of this invention, there is provided a special tool for being attached to the torsion damper covering the endoof the crankshaft which makes it possible to employ a long handled wrench giving adequate leverage to rotate the crankshaft to make the valve adjustments.

It is thus a principal object of this invention to provide a simple and inexpensive way of manually rotating a crankshaft in an internal combustion engine.

Other objects and advantages of this invention will hereinafter become obvious from the following detailed description of preferred embodiments of this invention.

DESCRIPTION OF THE PREFERRED EMBODIMENTS

Figure 3:
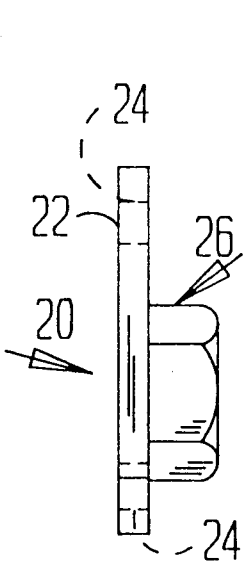
FIG. 3 is an end view of the tool.
Figure 2:
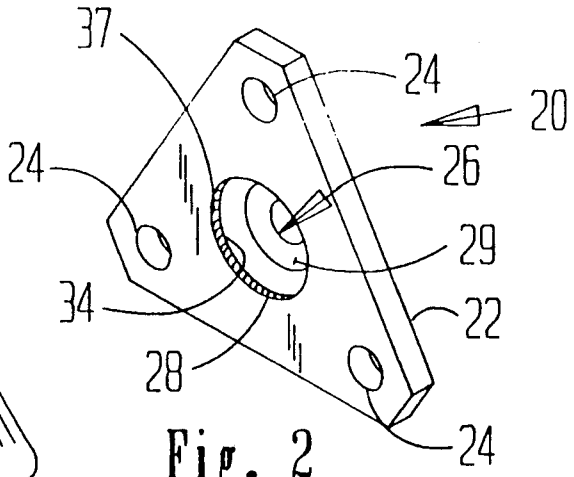
FIG. 2 is an isometric view of the tool embodying the principles which is mounted on the torsion damper.
Figure 4:
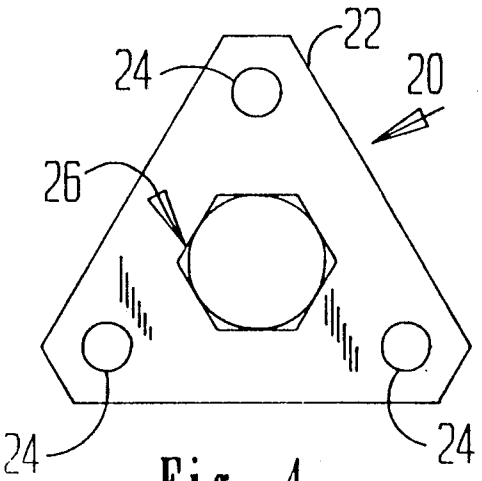
FIG. 4 is a right side view of the tool shown in FIG. 3.
Figure 1:
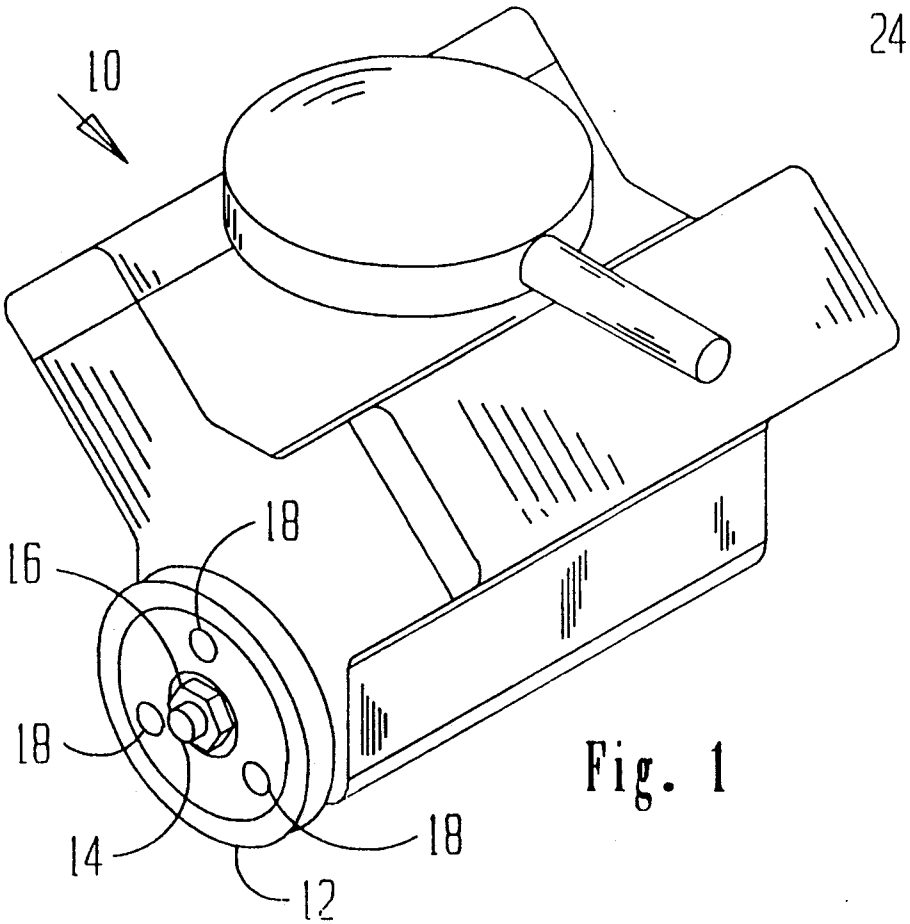
FIG. 1 is an illustrative, isometric view of a V-8 internal combustion engine of the kind typically found in racing cars, with the pulley wheel and fan belts removed.

Referring to FIG. 1 there is illustrated a Chevrolet V-8 internal combustion engine 10 of conventional design with torsion damper 12 shown mounted on the end of crankshaft 14. A nut 16 threaded onto the end of crankshaft 14 is employed to attach damper 12 thereto.

Damper 12 is provided, in this case, which is typical, with three threaded holes 18 which are employed to mount thereon a pull tool (not shown). In a racing version of the engine the water pump and other accessories are driven by an electric motor as is understood in the art. For other applications of the engine, as in a passenger car, the belt pulley would be mounted on damper 12 using holes 18.

The details of construction of damper 12 do not form a part of this invention.

Figure 7:
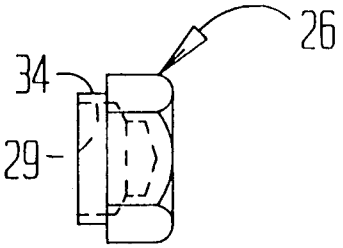
FIG. 7 is an end view of the hex head.
Figure 8:
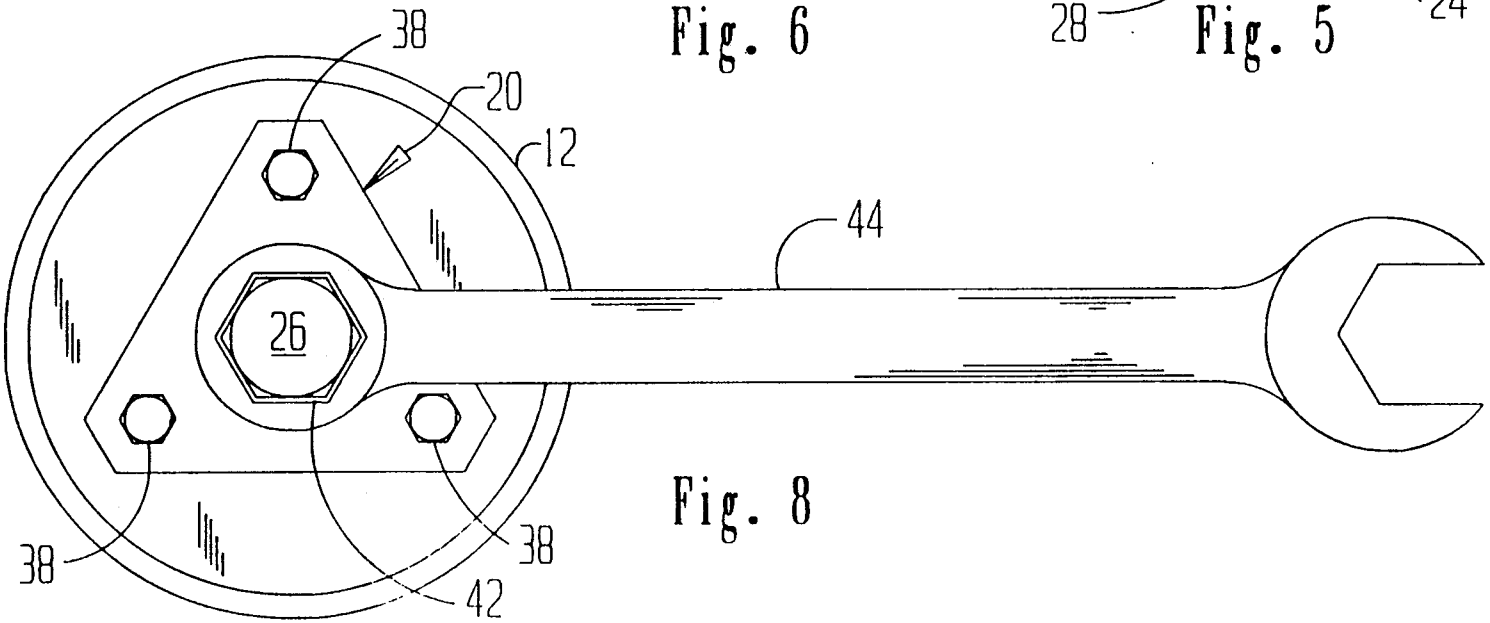
FIG. 8 is a front view of the tool mounted and being used to rotate the crankshaft.

For the details of tool 20 incorporating the principles of this invention to be mounted on damper 12 as illustrated in FIG. 8 to be described later, reference is made to FIGS. 2–7.

Tool 20 comprises a base plate 22 which is triangular in configuration and having holes 24 which would be aligned with threaded openings 18 in damper 12 when tool 20 is mounted on damper 12.

Mounted on one side of plate 22 in the center is a hex head member 26 having a hex nut shape on the outside and being hollowed out forming a socket 29 on the inside and exposed through an opening 28 in plate 22.

Figure 5:
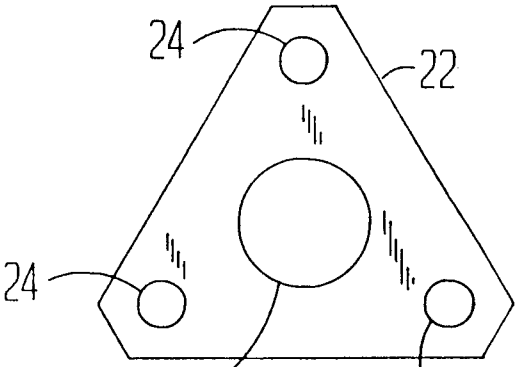
FIG. 5 is a face view of the mounting plate of the tool.
Figure 6:
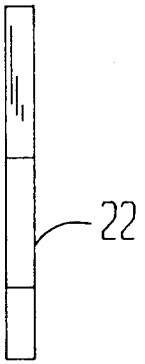
FIG. 6 is an nnd view of the mounting plate.

As best seen in FIGS. 5–7, as noted earlier, hex head member 26 is provided with a socket 29 on the inside which is large enough to accomodate hex nut 16 mounted on the end of crankshaft 14 without making contact with nut 16.

Hex head member 26 also has a neck 34 extending from the side having the entrance to socket 29, which is circular in cross section and having a diameter so that it can be inserted into opening 28 in mounting plate 22. When hex head member 26 is assembled with plate 22 so that neck 34 is inside of opening 28, then the two parts are welded together along the inside shown by bead 37 in FIG. 2.

Referring to FIG. 8 for a description of how tool 20 is used to rotate crankshaft 14 in engine 10, tool 20 is mounted on damper 12. Mounting plate 22 is secured to damper 12 by aligning its holes 24 to threaded holes 18 and threading in machine screws 38. When this is accomplished, it will be seen that nut 16 on the end of crankshaft 14 will protrude into socket 29 of hex head member 26 without making contact therewith.

Then, the socket 42 of a long handled wrench 44 is placed on the outside of hex head member 26 and conveniently turned in either direction to rotate crankshaft 14. Any length wrench may be used to obtain the torque which is required to rotate crankshaft 14 without undue effort by the mechanic.

The use of tool 20 is simple and does not involve tampering with the crankshaft or its means of attachment to the damper. It is also economical to manufacture and very cost effective both in its making and in its application.

While only certain preferred embodiments of this invention have been described it is understood that many variations of the invention are possible without departing from the principles of this invention as defined in the claims which follow.

What is claimed is:

1. The method of manually rotating the crankshaft of an internal combustion engine, said engine having a crankshaft with a damper mounted on one end thereof and secured by a nut engaged to the end of said crankshaft and a pulley wheel removed from said damper, comprising the steps of bolting to said damper in place of said pulley wheel a tool means, said tool means comprising a mounting plate with an opening surrounding said nut and head means mounted on the outside of said plate over said opening having a socket aligned with said opening to accomodate said nut and having a configuration on the outside capable of engaging a wrench, placing a wrench in engagement with said head means, and turning said wrench in either direction to rotate said crankshaft in any direction desired.

* * * * *